US006050828A

United States Patent [19]

Leeman et al.

[11] Patent Number: 6,050,828

[45] Date of Patent: Apr. 18, 2000

[54] RF COAXIAL PLUG CONNECTOR PART

[75] Inventors: Reginald Leeman, Ostend; Edgard Acke; Bernard Houtteman, both of Oostkamp; Roger Schoubben, Zedelgem; Kris Germonpre, Oostkamp, all of Belgium

[73] Assignee: Siemens Aktiengesellschaft, Munich, Germany

[21] Appl. No.: 09/195,934

[22] Filed: Nov. 19, 1998

[30] Foreign Application Priority Data

Nov. 19, 1997 [DE] Germany ..... 197 51 311

[51] Int. Cl.[7] ..... H01R 24/02

[52] U.S. Cl. ..... 439/63

[58] Field of Search ..... 439/63, 579, 581, 439/603, 931

[56] References Cited

FOREIGN PATENT DOCUMENTS

0555933B1 8/1993 European Pat. Off. .

2920091 11/1980 Germany .

197 46 637 10/1997 Germany .

19716139C1 6/1998 Germany .

*Primary Examiner*—Neil Abrams

*Attorney, Agent, or Firm*—Herbert L. Lerner; Laurence A. Greenberg; Werner H. Stemer

[57] ABSTRACT

An RF coaxial plug connector part includes coaxial plug parts disposed at a front of a housing of a coaxial plug part module mounted on or attached to a board, for example a printed circuit board. The housing has a grid-type frame which defines its external dimensions, is open on all sides, has frame parts that are disposed at right angles to one another, and is made of a first plastic, which cannot be metallized. Free spaces in the grid-type frame are completely filled with cable inserts which are DC-isolated from one another by the frame parts and are made of a second plastic, which can be metallized. At least one coaxial connecting cable, which extends from the front surface to the lower surface of the housing is integrated in each of the cable inserts.

8 Claims, 3 Drawing Sheets

RF COAXIAL PLUG CONNECTOR PART

BACKGROUND OF THE INVENTION

Field of the Invention

The invention relates to an RF coaxial plug connector part, including coaxial plug parts disposed at a front of a plastic housing of a coaxial plug part module mounted on or attached to a board, for example a printed circuit board, inner conductors each inserted in the housing and insulated within an outer conductor in the housing, and the housing having a lower surface with an edge accommodating a multiplicity of contact stand feet having standing surfaces representing SMD connections and used both for mounting the housing on the board or attaching it to the board as well as for conductive connection of the SMD connections to connections disposed on the board side.

Such an RF coaxial plug connector part has already been disclosed in German Patent DE 197 16 139 C1 and German Published, Non-Prosecuted Patent Application DE 197 46 637 A1, corresponding to U.S. patent application Ser. No. 09/176,816, filed Oct. 22, 1998. In comparison with such monoblocks of a known type, as have been disclosed, for example, in European Patent 0 555 933 B1, the structure of such a coaxial plug part module has the advantage of being considerably less expensive to manufacture and having a lower overall weight.

The housing of the coaxial plug part module in which the coaxial connecting cables are integrated between its front coaxial plug parts and its connections that are provided on the lower surface or underside in the form of contact stand feet with SMD connections, must be metallized at least in the region of its tubular inner wall parts (that form the outer conductors of the coaxial connecting cables) as well as on its front surface and its lower surface. During production it is simple to metallize the entire housing internally and externally except for annular zones which are free of metallization around the contact stand feet (which are associated with the inner conductors) with the SMD connections.

In that case, all of the outer conductors of the coaxial connecting cables are then jointly at a ground potential. If the outer conductors of the coaxial connecting cables including their front coaxial plug parts are intended to be at mutually isolated potentials, the metallization on the outer walls of the housing must be interrupted in a suitable manner between the outer conductors of the coaxial connecting cables. That can be done through the use of a cutting method using a laser or through the use of mechanical milling. Those cutting methods are relatively labor-intensive and involve a considerable amount of time.

SUMMARY OF THE INVENTION

It is accordingly an object of the invention to provide an RF coaxial plug connector part, which overcomes the herein-aforementioned disadvantages of the heretofore-known devices of this general type in such a way that, while maintaining simple metallization of a housing, it is possible to completely dispense with subsequently cutting the metallization on outer walls of the housing to provide DC isolation or potential separation between outer conductors of coaxial connecting cables.

With the foregoing and other objects in view there is provided, in accordance with the invention, an RF coaxial plug connector part, comprising a coaxial plug part module to be mounted on or attached to a board, for example a printed circuit board, and having a housing open on all sides;

the housing having a grid-type frame defining external dimensions of the housing and defining free spaces in the grid-type frame, the housing having frame parts disposed at right angles to one another, a front surface, a lower surface, and an edge of the lower surface, the housing formed of a first plastic which cannot be metallized; coaxial plug parts disposed at the front surface of the housing; outer conductors disposed in the housing and inner conductors disposed in the housing and each inserted within and insulated from a respective one of the outer conductors; cable inserts completely filling the free spaces, the cable inserts DC-isolated from one another by the frame parts, formed of a second plastic which can be metallized, and having inner wall parts forming the outer conductors and end surfaces on the front surface and the lower surface of the housing; a multiplicity of contact stand feet disposed at the edge of the lower surface of the housing, the contact stand feet having standing surfaces representing SMD connections for mounting the housing on or attaching the housing to the board and for a conductive connection of the SMD connections to connections of the board, the contact stand feet with the SMD connections forming part of the cable inserts; and at least one coaxial connecting cable extending from the front surface to the lower surface of the housing, the at least one coaxial connecting cable integrated in each of the cable inserts with the aid of a metallization of the cable inserts at least in vicinity of the inner wall parts and the end surfaces.

The invention is based on the knowledge that, by using a grid-type frame for the housing made of plastic which cannot be metallized, all of the cable inserts which are inserted in this grid-type frame and are composed of a plastic which can be metallized are always DC-isolated from one another even if the completed housing is metallized in a metallization bath, in a simple manner. If the outer conductors of two or more coaxial connecting cables in the coaxial plug part module are at the same potential, that is to say they are conductively connected to one another, then this can easily be achieved with an appropriate structure of the grid-type frame, by placing these coaxial connecting cables jointly in one cable insert.

In accordance with another feature of the invention, there are provided inner conductor connecting feet for the inner conductors of the coaxial connecting cables in the cable inserts, instead of contact stand feet with SMD connection, the inner conductor connecting feet disposed in groove channels pointing outward and open toward the lower surface of the housing.

In accordance with a further feature of the invention, the contact stand feet are short, outer wall, supporting web-type attachments to the cable inserts, and the inner conductor connecting feet have free ends projecting out of the groove channels to the side of the contact stand feet.

In accordance with an added feature of the invention, the coaxial connecting cables of the cable inserts are straight coaxial connecting cables, and the lower surface of the housing including the grid-type frame with the cable inserts is located on a side opposite the front surface.

In accordance with an additional feature of the invention, the coaxial connecting cables of the cable inserts are rectangular coaxial connecting cables, and the lower surface of the housing including the grid-type frame with the cable inserts is a housing surface pointing at right angles to the front surface.

In accordance with yet another feature of the invention, the outer conductors of the coaxial plug parts on the front surface of the housing are an integral component of the cable inserts in the housing.

In accordance with a concomitant feature of the invention, the coaxial plug parts have outer conductor sockets on the front surface of the housing in the form of metallic sleeves screwed, pressed or inserted into end-face recesses formed in the cable inserts.

Other features which are considered as characteristic for the invention are set forth in the appended claims.

Although the invention is illustrated and described herein as embodied in an RF coaxial plug connector part, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
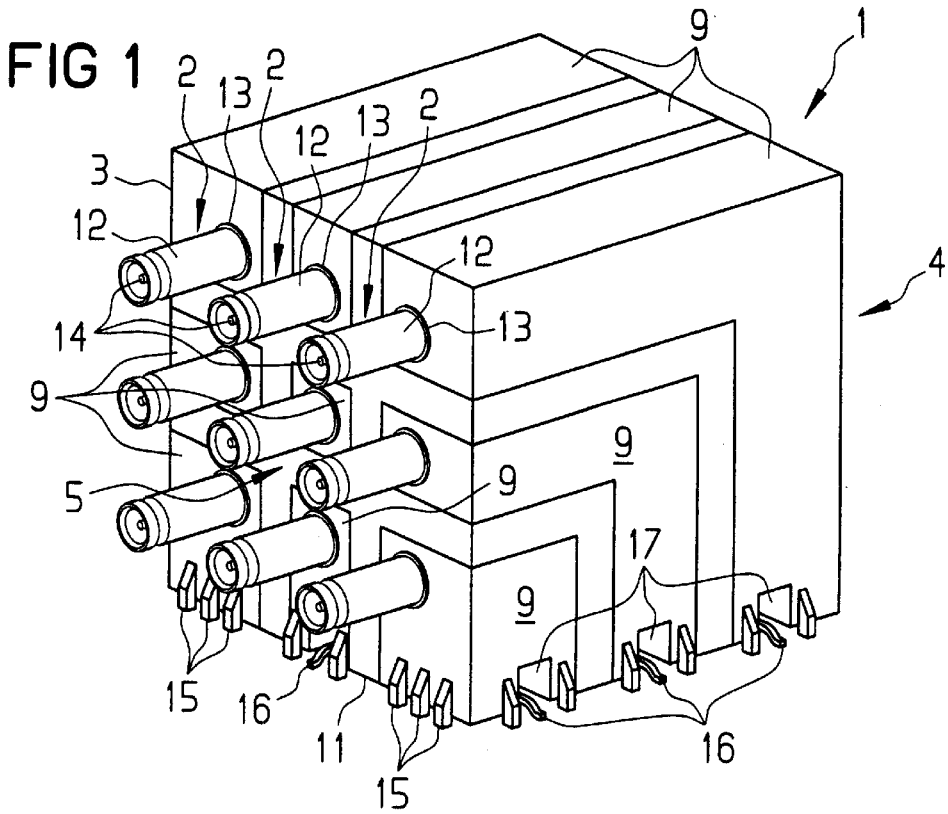
FIG. 1 is a diagrammatic, perspective view of a coaxial plug part module having a grid-type frame.

Referring now to the figures of the drawings in detail and first, particularly, to FIG. 1 thereof, there is seen an exemplary embodiment of a coaxial plug part module 1 which is constructed as an angled plug connector part. The coaxial plug part module 1 is constructed for nine coaxial connecting cables, having coaxial plug parts 2 which project out of a front surface 3 of its plastic housing 4, in a row-and-column configuration. The number and configuration of the coaxial plug parts 2 fitted in such coaxial plug connector parts can, of course, be varied.

Figure 2:
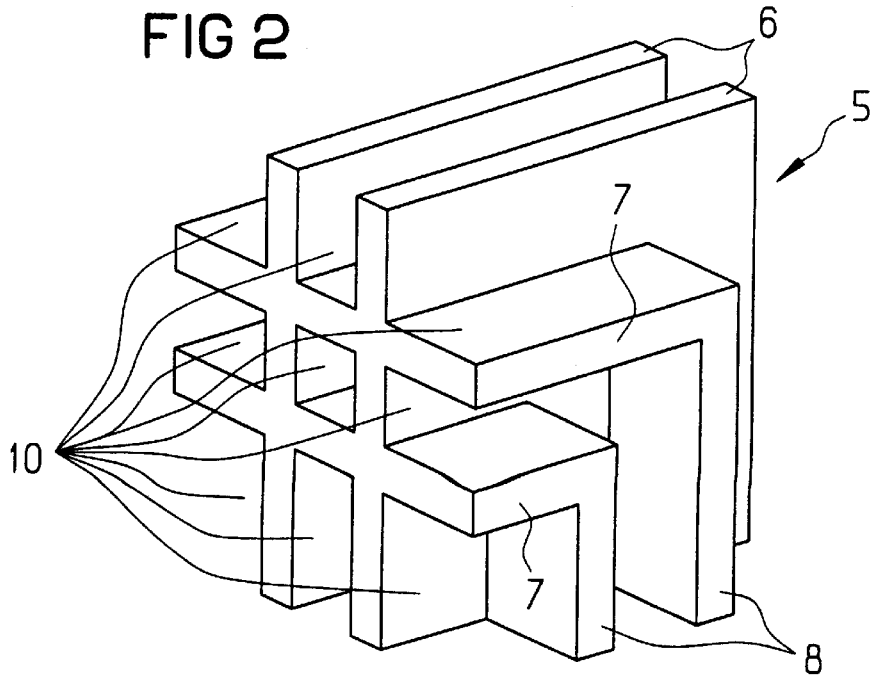
FIG. 2 is a perspective view of a grid-type frame which defines external dimensions of a housing for the coaxial plug part module in FIG. 1.

The housing 4 of the coaxial plug part module 1 includes a grid-type frame 5 which defines its external dimensions, is open on all sides, has frame parts 6, 7 and 8 pointed at right angles to one another, and is illustrated in FIG. 2. The grid-type frame 5 is completed to form the housing 4 through the use of nine cable inserts 9, which are inserted into free spaces 10 in the grid-type frame 5. In contrast to the gridtype frame 5, the cable inserts 9 are composed of a plastic which can be metallized. A coaxial connecting cable is integrated in each of the cable inserts 9, for extending conductors of the coaxial plug parts 2 on the front surface 3 of the housing 4 as far as a lower surface 11 of the housing 4. To this end, the cable inserts 9 are metallized in the region of their inner wall parts, which represent the outer conductors of the coaxial connecting cables, and in the region of their outer wall parts, which are exposed in the housing 4. In this case the metallization coating thickness is constructed to be at least equal to the penetration depth of electromagnetic waves which are transmitted through the coaxial plug part module 1. The grid-type frame 5 is composed, as already mentioned, of a plastic which cannot be metallized. For this reason, the metallization on the cable inserts can be carried out in a simple manner, while ensuring the desired DC isolation or potential separation between the outer conductors of the coaxial connecting cables integrated in them, after the cable inserts 9 have been inserted into the free spaces 10 in the grid-type frame 5, that is to say after completion of the housing 4.

In all of the exemplary embodiments illustrated in FIGS. 1 to 5, outer conductor sockets 12 of the coaxial plug parts 2 of the coaxial connecting cables are metal sleeves which are screwed into end-face recesses 13 in the cable inserts 9, to the side of the front surface 3 of the housing 4. Inner conductors 14 are held in insulating sleeves, which cannot be seen, in these outer conductor sockets 12 and those outer conductors, which continue further, of the coaxial connecting cables that are integrated in the cable inserts 9. The coaxial plug parts 2 may be constructed as male or female plug parts.

The housing 4 of the coaxial plug part module 1 has contact stand feet 15 with SMD connections which can be tinned at the foot end. These contact stand feet 15 are fitted to outer walls of the cable inserts 9, close to the lower surface 11 of the housing 4. They are used both for mounting the coaxial plug part module 1 on a connecting board, and for connecting the outer conductors of the coaxial connecting cables to connections disposed on the connecting board.

Inner conductor connecting feet 16 are provided for corresponding connections of the inner conductors 14 on the lower surface 11 of the housing 4. Instead of using contact stand feet 15 with SMD connections, the inner conductor connecting feet 16 are disposed in groove channels 17 (which point outward and are open toward the lower surface 11 of the housing 4) in the cable inserts 9, and have free ends projecting out of the groove channels 17 to the side of the contact stand feet 15.

Figure 3:
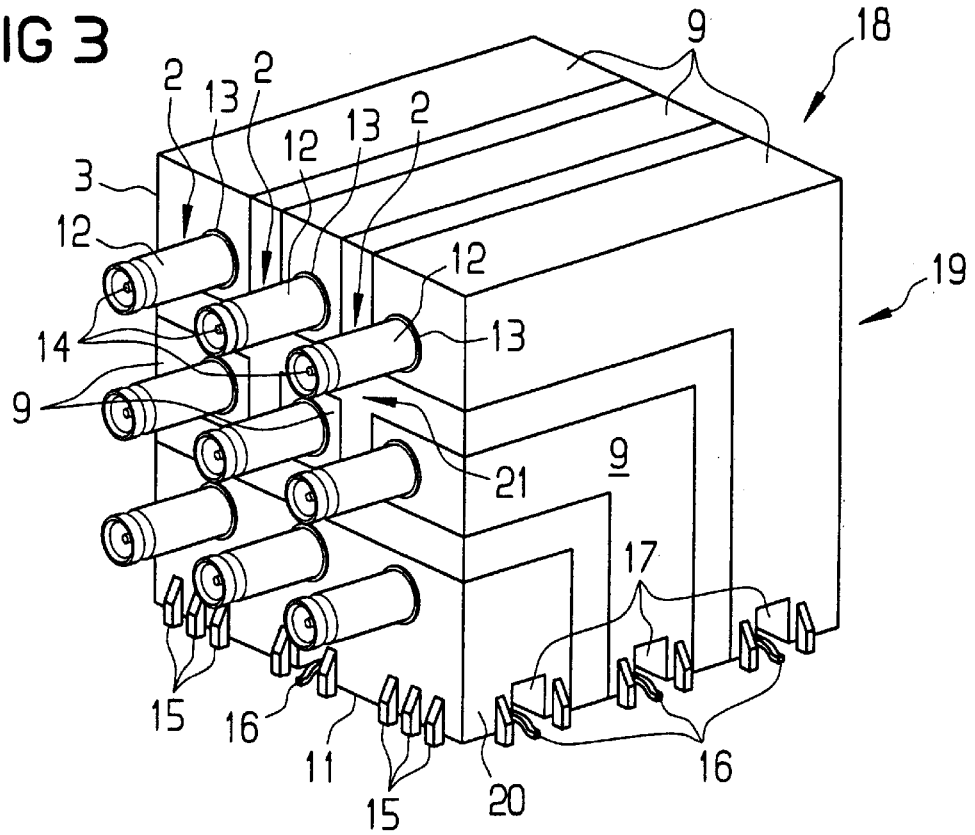
FIG. 3 is a view similar to FIG. 1 of a further coaxial plug part module having a grid-type frame.
Figure 4:
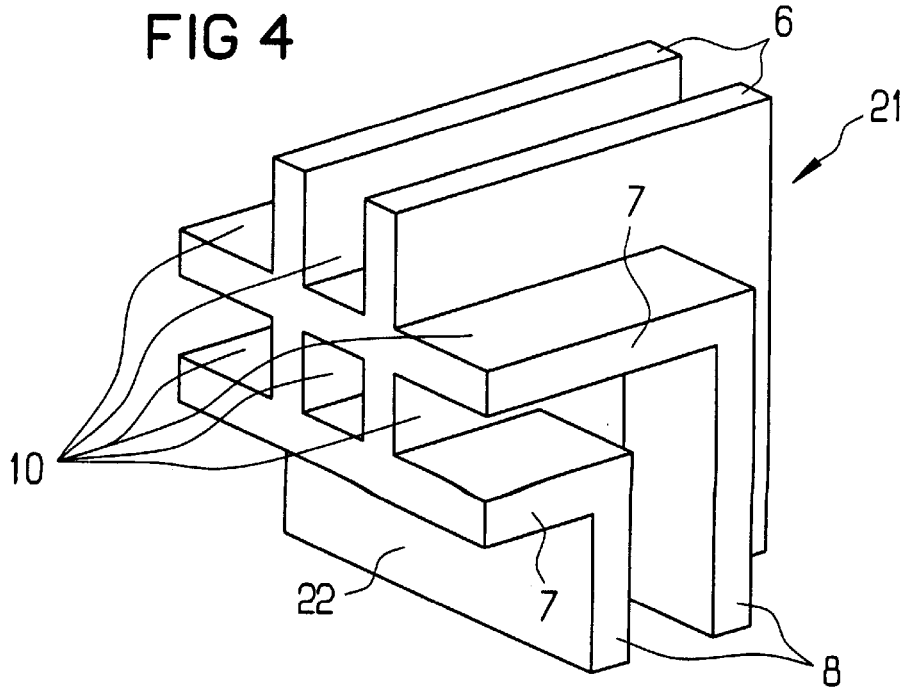
FIG. 4 is a view similar to FIG. 2 of a grid-type frame which defines the external dimensions of the housing for the other coaxial plug part module in FIG. 3.

Corresponding to FIGS. 1 and 2, FIGS. 3 and 4 show a further exemplary embodiment of an angled coaxial plug connector part. A coaxial plug part module 18 is once again constructed for nine coaxial connecting cables, but has only six cable inserts 9, in each of which a coaxial connecting cable is integrated. Instead of the three lower cable inserts 9 in the housing 4 of the coaxial plug part module 1 in FIG. 1, these three lower cable inserts 9 in a housing 19 of the coaxial plug part module 18 in FIG. 3 are combined to form a single cable insert 20, with three coaxial connecting cables integrated therein. Such combinations are expedient if, as is envisaged herein, the outer conductors of the three coaxial connecting cables which are associated with the cable insert 20 are intended to be at the same potential. As is particularly evident in the case of a grid-type frame 21 which is illustrated in FIG. 4 and is used for the housing 19, the cable insert 20 requires a correspondingly enlarged free space 22 for the insertion of the cable insert 20.

Figure 5:
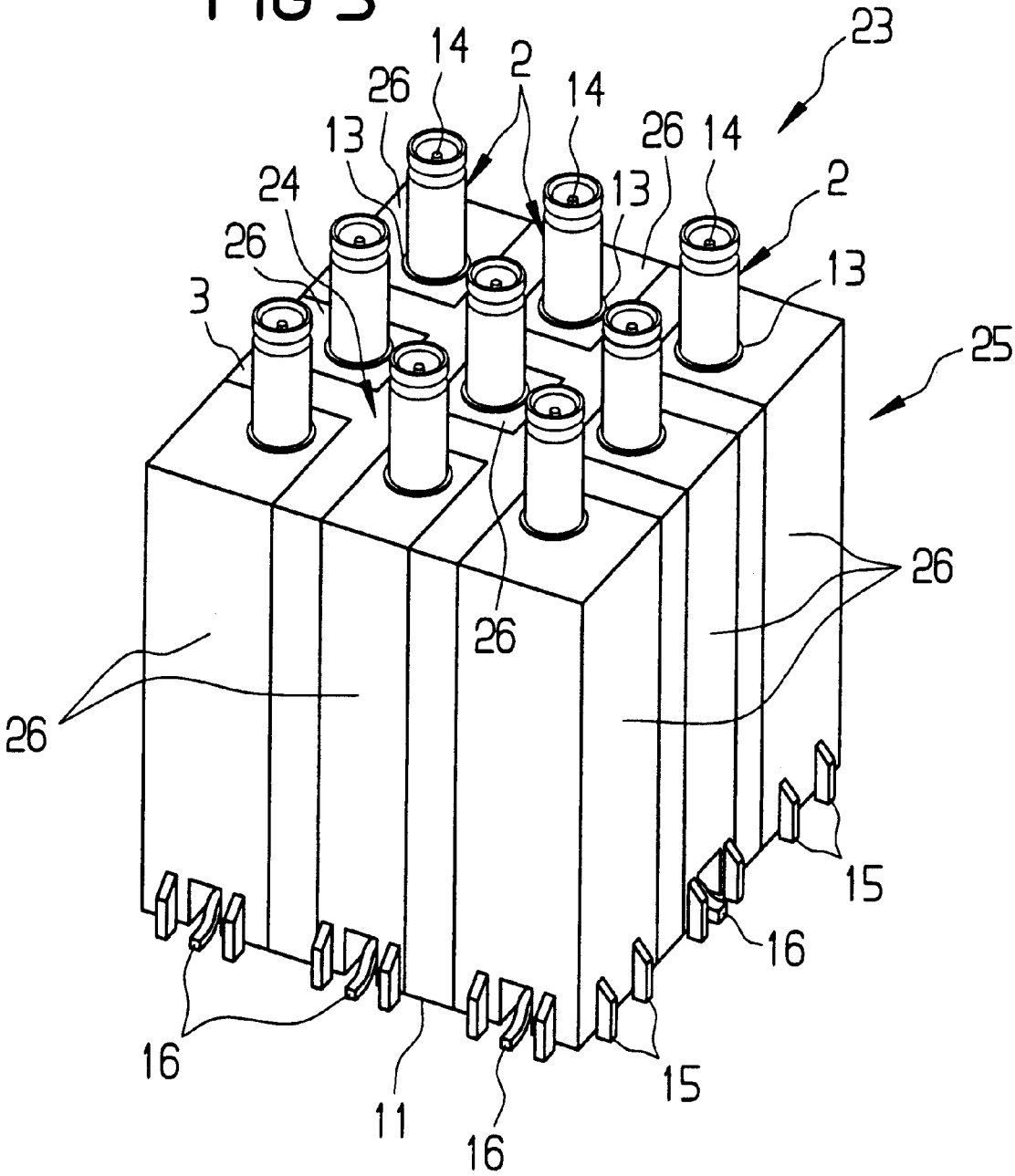
FIG. 5 is a perspective view of a further coaxial plug part module.

The coaxial plug connector part, which is preferably constructed as an angled coaxial plug connector part, may also be a straight plug connector part, as is illustrated in FIG. 5. In a manner corresponding to the coaxial plug part module 1 in FIG. 1, a coaxial plug part module 23 in FIG. 5 is likewise constructed for nine coaxial connecting cables. In contrast to the grid-type frame 5 in the housing 4 of the coaxial plug part module 1 in FIGS. 1 and 2, a grid-type frame 24 of a housing 25 of the coaxial plug part module 23 for accommodating nine cable inserts 26 has only intrinsically straight free spaces, which are not shown in great detail in FIG. 5.

We claim:

1. An RF coaxial plug connector part, comprising:

a coaxial plug part module to be mounted at a board and having a housing open on all sides;

said housing having a grid-type frame defining external dimensions of said housing and defining free spaces in said grid-type frame, said housing having frame parts disposed at right angles to one another, a front surface, a lower surface, and an edge of said lower surface, said housing formed of a first plastic which cannot be metallized;

coaxial plug parts disposed at said front surface of said housing;

outer conductors disposed in said housing and inner conductors disposed in said housing and each inserted within and insulated from a respective one of said outer conductors;

cable inserts completely filling said free spaces, said cable inserts DC-isolated from one another by said frame parts, formed of a second plastic which can be metallized, and having inner wall parts forming said outer conductors and end surfaces on said front surface and said lower surface of said housing;

a multiplicity of contact stand feet disposed at said edge of said lower surface of said housing, said contact stand feet having standing surfaces representing SMD connections for mounting said housing at the board and for a conductive connection of said SMD connections to connections of the board, said contact stand feet with said SMD connections forming part of said cable inserts; and at least one coaxial connecting cable extending from said front surface to said lower surface of said housing, said at least one coaxial connecting cable integrated in each of said cable inserts by a metallization of said cable inserts at least in vicinity of said inner wall parts and said end surfaces.

2. The RF coaxial plug connector part according to claim 1, wherein said coaxial plug part module is mounted at a printed circuit board.

3. The RF coaxial plug connector part according to claim 1, including inner conductor connecting feet for said inner conductors of said coaxial connecting cables in said cable inserts, said inner conductor connecting feet disposed in groove channels pointing outward and open toward said lower surface of said housing.

4. The RF coaxial plug connector part according to claim 2, wherein said contact stand feet are short, outer wall, supporting web-type attachments to said cable inserts, and said inner conductor connecting feet have free ends projecting out of said groove channels to the side of said contact stand feet.

5. The RF coaxial plug connector part according to claim 1, wherein said coaxial connecting cables of said cable inserts are straight coaxial connecting cables, and said lower surface of said housing including said grid-type frame with said cable inserts is located on a side opposite said front surface.

6. The RF coaxial plug connector part according to claim 1, wherein said coaxial connecting cables of said cable inserts are rectangular coaxial connecting cables, and said lower surface of said housing including said grid-type frame with said cable inserts is a housing surface pointing at right angles to said front surface.

7. The RF coaxial plug connector part according to claim 1, wherein said outer conductors of said coaxial plug parts on said front surface of said housing are an integral component of said cable inserts in said housing.

8. The RF coaxial plug connector part according to claim 1, wherein said coaxial plug parts have outer conductor sockets on said front surface of said housing in the form of metallic sleeves screwed, pressed or inserted into end-face recesses formed in said cable inserts.

* * * * *